US005325600A

United States Patent [19]

Gentile

[11] Patent Number: 5,325,600

[45] Date of Patent: Jul. 5, 1994

[54] METHOD AND APPARATUS FOR THE PREVENTION OF SCORCHING OF FABRIC SUBJECTED TO MICROWAVE HEATING

[75] Inventor: Philip J. Gentile, East Syracuse, N.Y.

[73] Assignee: Micro Dry, Inc., Tulsa, Okla.

[21] Appl. No.: 863,997

[22] Filed: Apr. 6, 1992

[51] Int. Cl.[5] ..... F26B 3/347

[52] U.S. Cl. ..... 34/260; 219/678; 34/261; 34/245; 34/266; 34/549

[58] Field of Search ..... 34/1 P, 1 Q, 1 R, 1 V, 34/1 W, 1 X, 1 Y, 1 DD, 133 R, 133 G, 133 J, 133 L, 48, 54, 55, 46, 50, 17, 68; 219/10.55 R, 10.55 B, 10.55 M

[56] References Cited

U.S. PATENT DOCUMENTS

| | | | |
|---|---|---|---|
| 3,439,431 | 4/1969 | Heidtmann | 34/1 DD |
| 3,854,219 | 12/1974 | Staats | 34/1 V |
| 4,334,136 | 6/1982 | Mahan et al. | 34/1 DD |
| 4,765,066 | 8/1988 | Yoon | 34/1 DD |
| 4,795,871 | 1/1989 | Strattan et al. | 219/10.55 M |
| 4,991,313 | 2/1991 | Joslin | 34/48 |

*Primary Examiner*—Denise Gromada
*Attorney, Agent, or Firm*—Salzman & Levy

[57] ABSTRACT

The present invention features a UV tube detector for sensing a resonant arcing condition in a microwave environment. Where clothing or fabric is being dried in a magnetron-powered, microwave chamber, the UV tube detector is placed in proximity to the fabric. The UV tube detector senses a possible resonant arcing condition related to small metal objects hidden in the material. Upon the sensing of arcing, tile UV tube provides a signal for shutting down the magnetron power. In conjunction with UV detection, the moisture condition can be monitored during the drying cycle. At a point in the microwave heating cycle consistent with an "end of microwave heating cycle" or "near dryness", the power output of the magnetrons is reduced or terminated. The moist fabric can then be dried via reduced microwave heating and/or by normal heating methods, including, but not limited to, electrical radiant heating and convection techniques. In this manner, it is possible to bring the fabric to a state of dryness, despite the presence of resonant arc-producing objects.

9 Claims, 2 Drawing Sheets

METHOD AND APPARATUS FOR THE PREVENTION OF SCORCHING OF FABRIC SUBJECTED TO MICROWAVE HEATING

FIELD OF THE INVENTION

The invention pertains to the microwave heating and drying of fabrics and, more particularly, to a method and apparatus for the prevention of fabric scorching due to resonant voltages produced by foreign objects resident within or on the fabric.

BACKGROUND OF THE INVENTION

In recent times, there has been much interest in the microwave heating and drying of fabrics. Some of the major advantages of the microwave drying of fabrics is the ability to sanitize the clothes, as illustrated in U.S. Pat. Nos. 4,896,010 and 4,829,679.

Another major advantage of microwave drying is the substantial reduction of lint and fabric wear which results from the speed of the drying process.

Through the years, a major drawback to the utilization of microwave heating and drying of fabrics has been the problem of arcing from large metal objects; this often results in the scorching and burning of fabric.

Recent progress has been achieved in preventing substantial arcing which is caused by permanent fabric fasteners, such as metal buttons, metal rivets and metal zippers. However, it is still problematical when drying fabrics on which small foreign metal objects (such as paper clips, hair pins, twist-ties with wire, etc.) are found. These small objects are often left in clothes pockets and are sometimes found in cuffs and folds of fabric.

Not only is the presence of small metal objects more difficult to ascertain, but paper clips and hair pins also present a different arcing problem than larger pieces of metal.

Paper clips, hair pins and twist-ties tend to resonate when subjected to high-powered microwave radiation, which produces voltages and currents sufficient to melt them. This condition, in turn, can cause scorching and burning of the fabrics in which they are imbedded.

Obviously, written warnings to inspect clothing and fabric are insufficient to protect against this hazard.

The resonant frequencies emitted by these small objects during microwave heating cannot be successfully detected. It was found that the emissions from these objects produced wide band amplitude modulated noise, with no specific frequency signature. What signals were detected were often in the low pico-watt range. Some of the emitted radiation was believed to be reabsorbed and converted to heat. The main factor causing lack of detection was determined to be the small size of these objects. A small "antenna" length is not sufficient to provide a reliably detectable electromagnetic signal.

The current invention has determined that these small objects can be detected by a "UVtron" device. A "UVtron" is a commercially available ultraviolet light detector tube, manufactured by Hamamatsu. The ultraviolet light detector tube operates in similar fashion to a phototube, wherein an ion chamber is biased in the discharge or avalanche region.

Arcs from resonant loads of small metal objects produce intense electromagnetic radiation between 100 and 800 nanometers. With or without appropriate selected range cutoff for ambient light triggering, the UV tube of this invention is able to reliably detect small metal objects subjected to microwave radiation. The detected signal is then used to terminate the drying operation.

In conjunction with the above detection apparatus, the invention also discovered that a resonant object in contact with moist or wet fabric tended not to arc as readily as when it was in contact with dry fabric. It was, therefore, determined that a possible arcing condition could be prevented by varying the power output of the magnetron as a function of time or as a function of sensed dryness. In other words, the power was reduced or terminated toward the end of the drying cycle, in order to reduce the possibility of arcing. The power can be cut off in the last few minutes of the microwave drying cycle, and the clothing brought to drying completion through normal hot air convection techniques, i.e., by using electrical radiant heating.

The "end of heating cycle" dryness condition can be sensed in a number of ways consistent with the teachings illustrated in U.S. Pat. No. 4,795,871.

SUMMARY OF THE INVENTION

The present invention features a UV tube detector for sensing a resonant arcing condition in a microwave environment. Where clothing or fabric is being dried in a magnetron-powered, microwave chamber, the UV tube detector is placed in proximity to the fabric. The UV tube detector senses a possible resonant arcing condition related to small metal objects hidden in the material. Upon the sensing of arcing, the UV tube provides a signal for shutting down the magnetron power. In conjunction with UV detection, the moisture condition can be monitored during the drying cycle. At a point in the microwave heating cycle consistent with an "end of microwave heating cycle" or "near dryness" condition, the power output of the magnetrons is reduced or terminated. The moist fabric can then be dried via reduced microwave heating and/or by normal heating methods, including, but not limited to, electrical radiant heating and convection techniques. In this manner, it is possible to bring the fabric to a state of dryness, despite the presence of resonant arc-producing objects.

BRIEF DESCRIPTION OF THE DRAWINGS

These and other objects of the invention will be better understood and will become more apparent with reference to the subsequent, detailed description considered in conjunction with the accompanying drawings, in which.

DESCRIPTION OF THE PREFERRED EMBODIMENT

Generally speaking, the invention relates to the detection and/or prevention of a resonant arcing condition in a microwave environment. By environment, it should be understood that the microwaving of foodstuffs, as within an oven, or the drying of fabrics, as in a microwave drying chamber, is the kind of microwave facility to which the present invention applies.

The invention utilizes a device referred to in the trade as a UVtron for the detection of a resonant arcing condition. Resonant arcing in a microwave environment is generally caused by the introduction of small metal objects such as paper clips, hair pins, twist-ties, etc.

Such small metal objects find their way into clothing inadvertently.

When a metallic object, such as a paper clip or a wire twist-tie, is exposed to microwave radiation, it will act as a small antenna. The incident microwaves will cause voltages and currents to travel along the length of the clip or tie. When the voltages exceed the local environment, a break-down voltage results in the arcing condition. The energy emitted by an arc is spread across the far ultraviolet end to well past the infrared part of the electromagnetic spectrum.

The UVtron of this invention is an ultraviolet light detector tube, similar to a phototube. The UVtron operates as an ion chamber biased in the discharge or avalanche region.

The UVtron is placed in the microwave chamber so that it will detect tile resonant arcing condition. A good area for placement is inside the chassis next to the intake air vent. It is important in such a placement to be sure that the vents are open, i.e., in line of sight of the chamber. The arc from the resonant object produces intense electromagnetic radition between 100 and 800 nanometers. The operation of the UVtron can be selected for a cutoff wave length of approximately 250 nm in order to provide immunity from false triggering by normal sources of ambient light. However, tests have shown that there is little interference from these extraneous light sources when detecting the resonant arcing condition. The output from the Uvtron tube will produce a dramatic pulse whenever arcing occurs.

Figure 1:
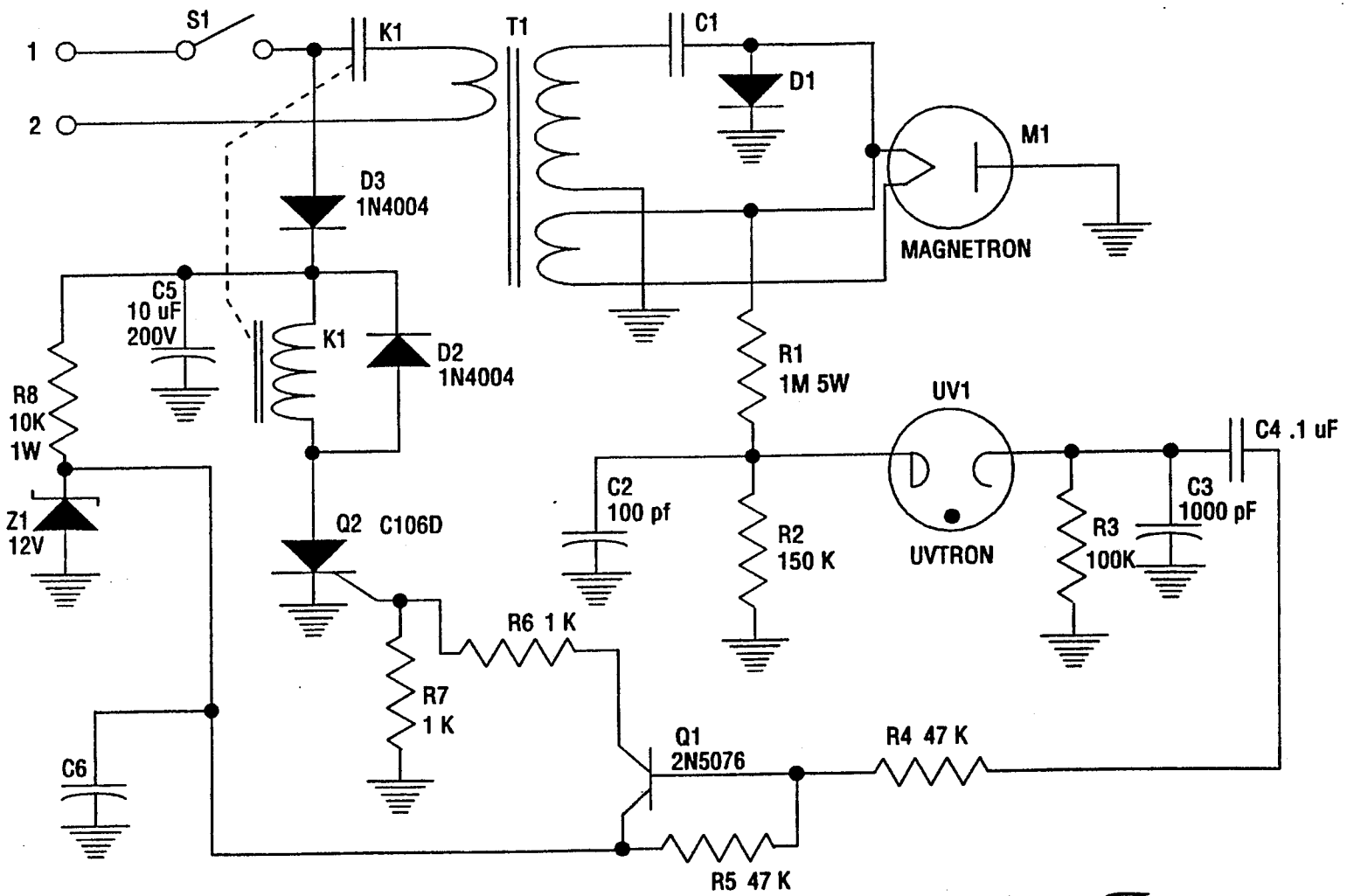
FIG. 1 illustrates a typical schematic diagram for the UVtron power supply and load circuit of the invention.

Referring to FIG. 1, a typical schematic diagram for the Uvtron power supply and load circuit is shown. The detection pulse of the Uvtron tube occurs at 16.67 ms intervals. This is the AC line cycle rate of the magnetron high voltage power supply.

The Uvtron in FIG. 1 can be obtained from Hamamatsu, Model No. R2868 Flame Sensor, although any type of ion chamber or ultraviolet detector can be used. In operation, extraneous signals, such as those produced by static electricity or cosmic rays, can be filtered out by powering the ultraviolet sensor only when the microwave power source is producing energy. In most microwave applications, energy is produced for only a fraction of each A.C. line cycle.

As aforementioned, varying amounts of fluorescent light and sunlight have no effect on UVtron performance; they neither create a false triggering condition nor degrade the sensitivity toward arc detection.

The fact that the high voltage supply operates at a 16.67 ms period allows a filtering to occur when static electricity discharges occur in a drying drum or oven chamber.

The synchronization of the UVtron with the high voltage supply ensures that noise is easily recognized by the detection system. Noise can result from static discharges, cosmic rays and radon gas decay.

FIG. 1 illustrates a circuit utilizing the UVtron detector, UV1, in combination with the standard microwave generating circuitry available in commercial practice, and comprising transformer T1, capacitor C1, diode D1, and magnetron M1. Placed on the atmospheric side of the air vent, tile UVtron UV1 is in full optical view of the microwave cavity (not shown). Resistors R1 and R2 attenuate the magnetron cathode voltage signal to within limits safely within the operative range of the UVtron UV1. Resistor R1 can be a 1M ohm, 5 Watt resistor, while resistor R2 could be 150K ohms of 1 Watt.

The capacitor C2 being a small value, typically about 100 pf, provides a bypass for high frequency noise, and a small charge for the UVtron UV1, if it should fire. Capacitor C3 absorbs the charge from capacitor C2, when the detector UV1 discharges. Resistor R3 sets the discharge RC time constant. This RC time constant depends upon the required signal processing circuitry; and for this circuit, C3 shall be 1,000 pf and R3 shall be 100K ohms.

The UVtron UV1 will discharge when the voltage on capacitor C2 reaches approximately 300 Vdc, if an arc is detected. This will result in a C3 voltage of about 30 VdC. This voltage will depend upon the on-state discharge voltage drop across the detector UV1.

The capacitor C4 couples the output signal to the inverting amplifier formed by the transistor Q1 and resistors R4, R5 and R6. When the output signal is produced, the transistor Q1 saturates and draws gate current from transistor SCR Q2. SCR Q2 then latches on, thus energizing inductor K1.

The power supply formed by inverter D3, capacitor C5, resistor RS, diode Z1, and capacitor C6, supplies power for transistors Q1, SCR Q2, and inductor K1, respectively. When the inductor K1 energizes, A.C. power to the magnetron M1 is caused to cease. Thus, the circuit shuts down the magnetron M1, if an arcing condition is detected.

Switch S1 must be cycled off and then on again, in order to re-energize the circuit. The UVtron UV1 can also be utilized in conjunction with a dryness sensor towards the end of the cycle, thus signalling the termination of the drying cycle, as explained more fully hereinafter.

The UVtron detection signal of the resonant arcing condition can be utilized to terminate the power to the magnetrons, thus preventing fabric damage.

Another method for preventing fabric damage utilizes the sensing of the dryness condition in the fabric load and "powering-down" the magnetrons. Powering-down the magnetrons entails reducing the power density, as an proportional function of load water content. The determination of water content in the fabric load can be easily measured by methods described in the aforementioned U.S. Pat. No. 4,795,871. Such methods are meant to be incorporated herein, by way of reference.

It is known from testing that, in order for resonant arcing to cause fabric damage, the arc must first evaporate the water in a localized region surrounding the metal object. Thereafter, the arcing must raise the temperature in this localized region of the fabric to one above its charring temperature. Therefore, if the power density in the drying chamber is lowered as the clothes dry, the field voltage can be kept low enough to prevent the resonant arcing condition. In this manner, the UVtron can prevent serious scorching or damage to fabrics containing small metal objects. The detection signal may also be used to switch from magnetron heating to conventional heating devices to bring the drying operation to its last stage of completion. Such conventional heating can be accomplished by a radiant heating source and by air flushing the chamber to remove moisture. Such a switch in heating modality will be explained hereinafter with respect to the method of the invention.

The UVtron detection circuit, coupled with the new drying modality of this invention, will ensure that fabric damage due to resonant arcing will be greatly reduced, if not completely eliminated.

Prior Art has determined that one of the methods of operating a microwave clothes drying system is to seal the heating chamber during microwave radiation. The moisture driven from the clothes is retained within the chamber, thus allowing the fabric to become sanitized, as described in U.S. Pat. Nos. 4,896,010 and 4,829,679. The teachings of these patents are meant to be incorporated herein by reference.

Figure 2:
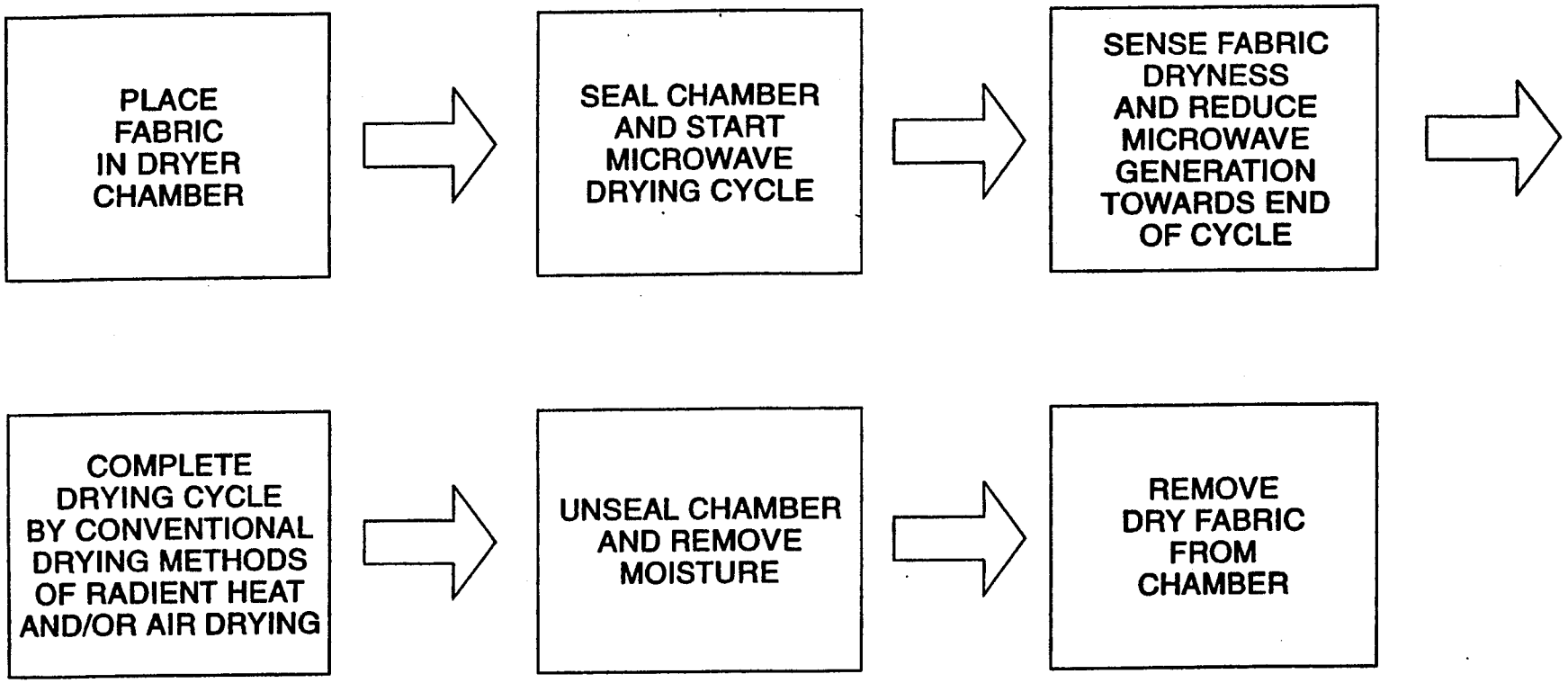
FIG. 2 shows a flow diagram of the drying method of this invention.

It has been observed that the arcing condition is suppressed in fabrics that are moist or in a moist environment. Therefore, reducing the power density as the dryness condition approaches completion, will substantially decrease the possibility of fabric damage via the arcing condition, as shown in the method depicted in the flow chart illustrated in FIG. 2.

The invention suggests that late stages of drying may be safely conducted without the arcing condition by switching to a supplemental drying cycle involving some radiant heat and/or an air-drying cycle. Sanitization can be maintained for the fabrics in an air-drying cycle through the use of appropriate filtering or ozone injection.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequent appended claims.

What is claimed is:

1. A method of preventing an arcing condition in a microwave fabric dryer, comprising the steps of:

a) determining approaching completion of a microwave drying cycle for fabric being dried in a microwave fabric dryer;

b) reducing microwave generation in response to said determining step (a); and c) completing a drying cycle by a radiant heating technique to substantially dry said fabric.

2. The method of claim 1, wherein the reducing step (b) comprises a complete cessation of microwave generation.

3. The method of claim 1, wherein the reducing step (b) comprises a powering-down of microwave generation.

4. The method of claim 3, wherein the powering-down of microwave generation is proportional function of water content in said fabric.

5. The method of claim 1, wherein said microwave fabric dryer is sealed during a substantial portion of a microwave drying cycle.

6. The method of claim 1, wherein step (c) further comprises the step of:

i) heating and drying a fabric to substantial dryness by an air convection technique.

7. The method of claim 1, wherein step (a) further comprises the step of:

i) sensing the dryness of said fabric toward the end of a microwave drying cycle.

8. The method of claim 1, further comprising the step of:

d) maintaining a seal in a heating chamber of said microwave fabric dryer during microwave heating.

9. The method of claim 1, further comprising the step of:

d) sealing the moisture driven from said fabric in a heating chamber of said microwave fabric dryer during microwave heating.

* * * * *